US007360998B2

(12) United States Patent
Burns

(10) Patent No.: US 7,360,998 B2
(45) Date of Patent: Apr. 22, 2008

(54) METHOD OF CLEANING OUT BLOCKAGES WHICH PREVENT OPERATION OF A RECIPROCATING DOWNHOLE TUBING PUMP

(75) Inventor: Bradley Gerald Burns, Lloydminster (CA)

(73) Assignees: 931289 Alberta Ltd., Lloydminster, Alberta (CA); 931285 Alberta Ltd., Lloydminster, Alberta (CA)

( * ) Notice: Subject to any disclaimer, the term of this patent is extended or adjusted under 35 U.S.C. 154(b) by 698 days.

(21) Appl. No.: 11/020,353

(22) Filed: Dec. 23, 2004

(65) Prior Publication Data

US 2005/0100446 A1 May 12, 2005

(51) Int. Cl.
*E21B 37/10* (2006.01)
*F04B 53/10* (2006.01)

(52) U.S. Cl. ..... 417/53; 417/430; 417/555.2; 166/311

(58) Field of Classification Search ..... 417/53, 417/430, 554, 555.2; 166/311
See application file for complete search history.

(56) References Cited

U.S. PATENT DOCUMENTS

| | | | | |
|---|---|---|---|---|
| 880,019 | A * | 2/1908 | Futhey | 417/445 |
| 5,382,142 | A * | 1/1995 | Spears | 417/445 |
| 5,941,311 | A | 8/1999 | Newton | |
| 7,051,813 | B2 * | 5/2006 | Hayes et al. | 166/332.1 |

FOREIGN PATENT DOCUMENTS

| | | |
|---|---|---|
| CA | 2 431 604 | 12/2004 |

* cited by examiner

*Primary Examiner*—Charles G Freay
(74) *Attorney, Agent, or Firm*—Christensen O'Connor Johnson Kindness PLLC

(57) ABSTRACT

A method of cleaning out blockages which prevent operation of a reciprocating downhole tubing pump. A first step involves mechanically displacing and disabling, without removing, a ball from a ball seat on the travelling ball valve. A second step involves mechanically displacing and disabling, without removing, a ball from a ball seat on the standing valve assembly. A third step involves inserting coil tubing through the travelling ball valve and the standing ball valve to cleanout the entire workstring and pump.

6 Claims, 2 Drawing Sheets

METHOD OF CLEANING OUT BLOCKAGES WHICH PREVENT OPERATION OF A RECIPROCATING DOWNHOLE TUBING PUMP

FIELD OF THE INVENTION

The present invention relates to a method of cleaning out blockages which prevent operation of a reciprocating downhole tubing pump.

BACKGROUND OF THE INVENTION

Canadian Patent Application 2,431,604, describes a method of circulating fluids through a reciprocating downhole tubing pump. In accordance with the teachings of that method, the following steps are taken. A first step involves providing first means for mechanically displacing and disabling, without removing, a ball from a ball seat on the travelling ball valve. A second step involves providing second means for mechanically displacing and disabling, without removing, a ball from a ball seat on the standing valve assembly. A third step involves activating the first means to prevent the ball from engaging the ball seat on the travelling ball valve and the second means to prevent the ball from engaging the ball seat on the standing ball valve assembly and circulating fluids through both the travelling ball valve and the standing ball valve assembly.

The circulation of fluids through the downhole tubing pump is usually sufficient to remove any sand build up which is causing a blockage and restore circulation. Unfortunately, there are blockages that are so severe that circulation cannot be restored using this method.

SUMMARY OF THE INVENTION

What is required is a method of cleaning out blockages which prevent operation of a reciprocating downhole tubing pump, without having to pull the tubing string and the downhole tubing pump from the well.

According to the present invention there is provided a method of cleaning out blockages which prevent operation of a reciprocating downhole tubing pump which has a standing ball valve and a travelling ball valve positioned downhole. A first step involves mechanically displacing and disabling, without removing, a ball from a ball seat on the travelling ball valve. A second step involves mechanically displacing and disabling, without removing, a ball from a ball seat on the standing valve assembly. A third step involves inserting coil tubing through the travelling ball valve and the standing ball valve to cleanout the entire workstring and pump.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

The preferred method of cleaning out blockages which prevent operation of a reciprocating downhole tubing pump will now be described with reference to FIGS. 1 and 2.

Figure 1:
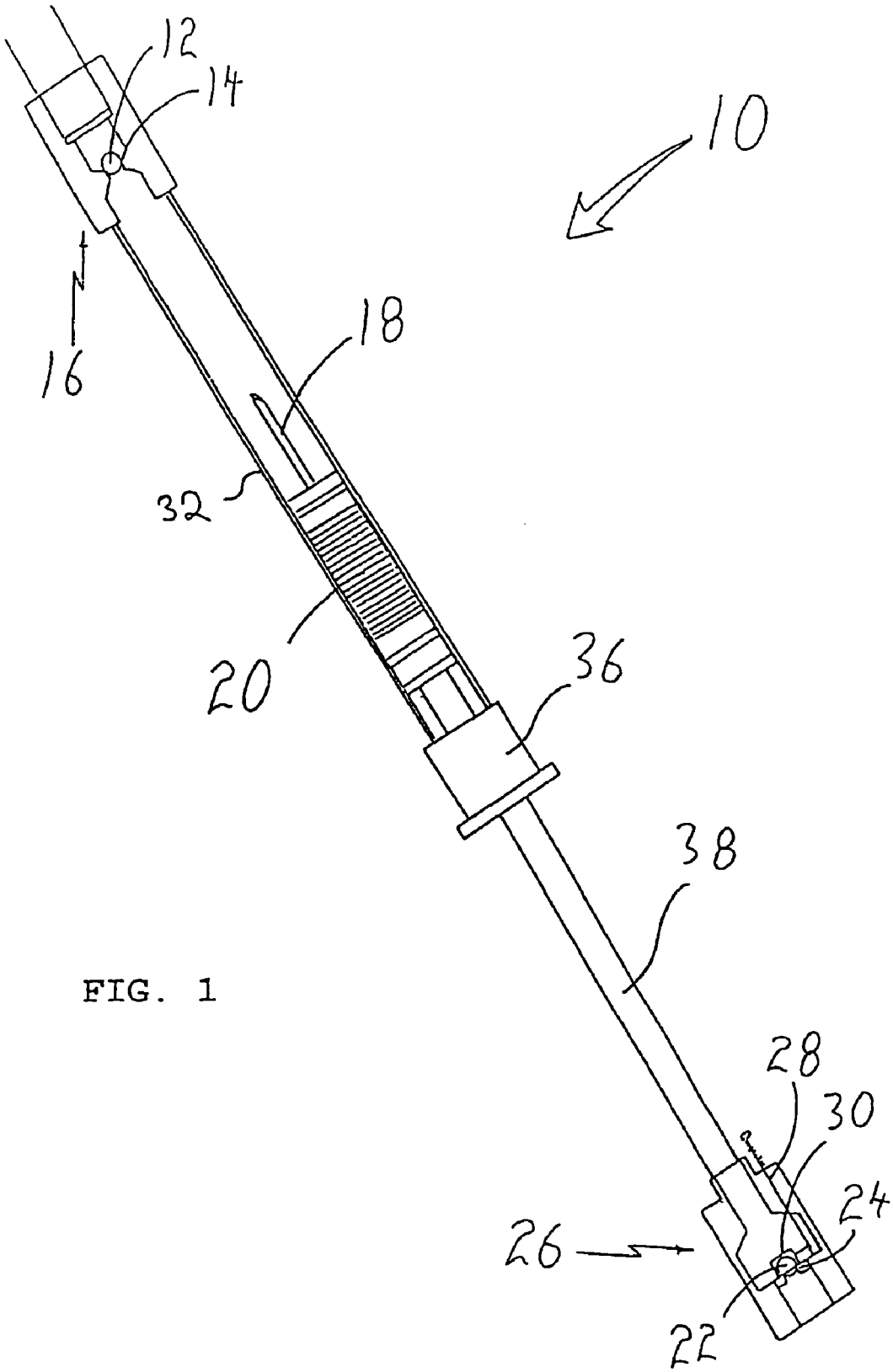
FIG. 1 is a side elevation view, in section, of an inverted reciprocating downhole tubing pump constructed in accordance with the teachings of the present method with the standing ball valve assembly and the travelling valve in an operative position.

Referring to FIG. 1, a pump with workstring 10 is provided. A first step involves providing means for mechanically displacing and disabling, without removing, a first ball 12 from a first ball seat 14 on a travelling ball valve 16. In the illustrated embodiment, an upstanding displacement member 18 is positioned in a first position on top of a piston assembly 20 in axial alignment with first ball seat 14 such that first ball 12 is displaced when piston assembly 20 is in a second position as illustrated in FIG. 2.

Referring to FIG. 1, a second step involves providing means for mechanically displacing and disabling, without removing, a second ball 22 from a second ball seat 24 on a standing ball valve assembly 26. In the illustrated embodiment, a linkage 28 is positioned in a first position in valve assembly 26. Second ball 22 is contained within a ball cage 30 which is pivotally linked to linkage 28 such that when pump barrel 32 is lowered onto standing ball valve assembly 26, ball cage 30 is moved to a circulating position when piston assembly 20 is in a second position as illustrated in FIG. 2.

Figure 2:
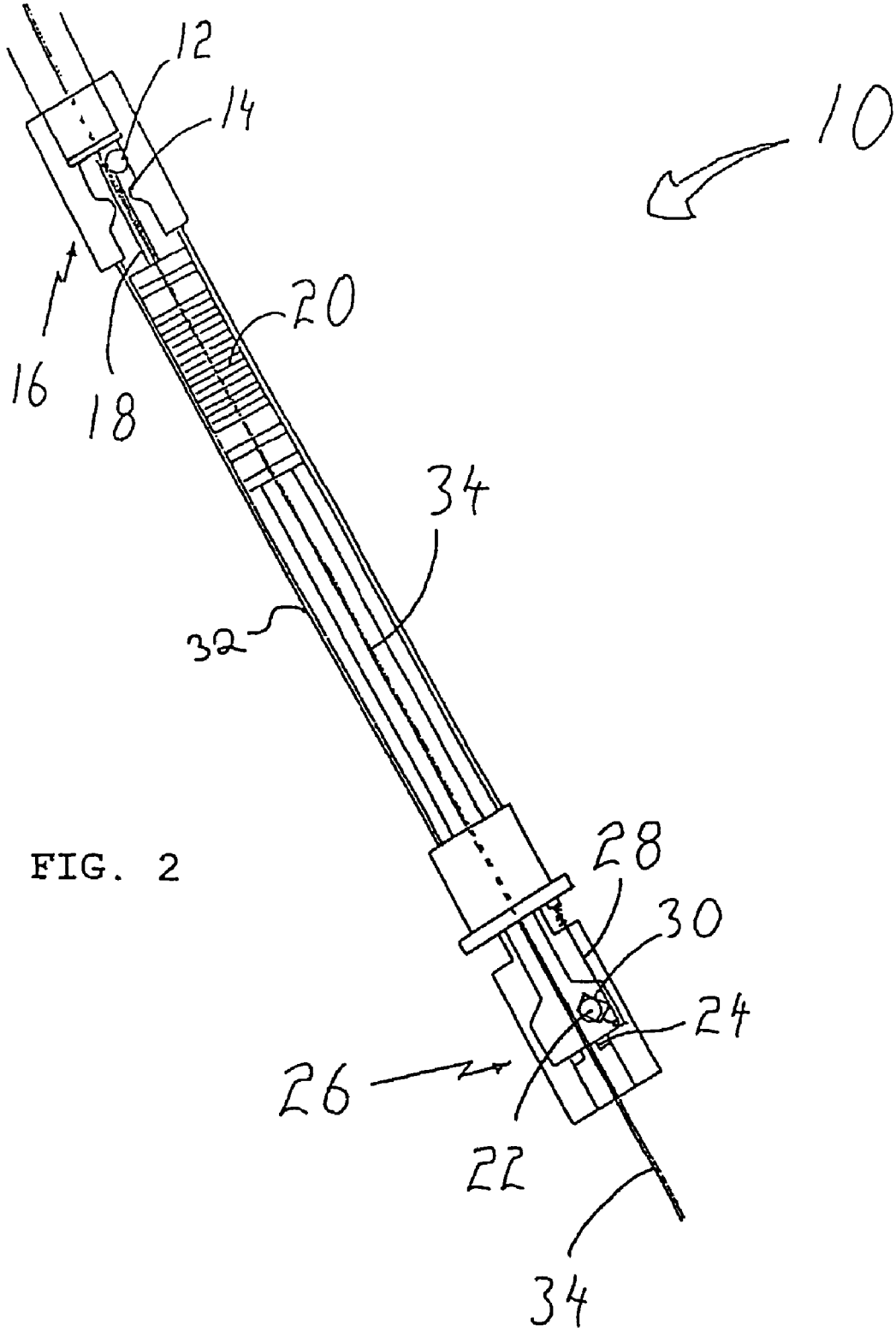
FIG. 2 is a side elevation view, in section, of the inverted reciprocating downhole tubing pump illustrated in FIG. 1, with the standing ball valve assembly and the travelling valve disabled to permit insertion of coil tubing.

Referring to FIG. 2, a third step involves inserting coil tubing 34 through travelling ball valve 16 and standing ball valve assembly 26 such that pump with workstring 10 is cleaned out.

The remaining aspects of pump with workstring 10 which are not part of the inventive concept will now be described. Referring to FIG. 1, pump with workstring 10 has a drive collar 36 and a kelly 38.

A person skilled in the art will note that the pumping unit has been illustrated in an inverted condition. This inverted condition has proven to be slightly more convenient for the teachings of this method. The pumping unit need not be inverted for the invention to work.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of cleaning out blockages which prevent operation of a reciprocating downhole tubing pump which has a standing ball valve and a travelling ball valve positioned downhole, comprising the steps of:

displacing and disabling, without removing, a ball from a ball seat on the travelling ball valve;

displacing and disabling, without removing, a ball from a ball seat on the standing valve assembly; and inserting coil tubing through the travelling ball valve and the standing ball valve to cleanout the entire workstring and pump.

2. A method of cleaning out blockages which prevent operation of a reciprocating downhole tubing pump which has a standing ball valve and a travelling ball valve positioned downhole, comprising the steps of:

providing first means for mechanically displacing and disabling, without removing, a ball from a ball seat on the travelling ball valve;

providing second means for mechanically displacing and disabling, without removing, a ball from a ball seat on the standing valve assembly;

activating the first means to prevent the ball from engaging the ball seat on the travelling ball valve and the second means to prevent the ball from engaging the ball seat on the standing ball valve assembly; and inserting coil tubing through the travelling ball valve and the standing ball valve to cleanout the entire workstring and pump.

3. The method as defined in claim 2, the first means for mechanically displacing and disabling, without removing, a ball from a ball seat on the travelling ball valve being an upstanding displacement member positioned on top of the piston assembly, the displacement member being in axial alignment with the ball seat which receives the ball on the travelling ball valve.

4. The method as defined in claim 2, the second means for mechanically displacing and disabling, without removing, a ball from a ball seat on the standing valve assembly being a linkage which displaces the ball from the ball seat when the pump barrel is lowered onto the standing ball valve assembly.

5. The method as defined in claim 4, the ball being secured to a ball cage, and the linkage being adapted to pivot the ball cage from an operative position to a circulating position in which the ball cage is raised and the ball on the standing ball valve assembly is lifted by the ball cage off the ball seat.

6. The method as defined in claim 2, the pump being inverted.

* * * * *